US007111401B2

(12) United States Patent
Richard

(10) Patent No.: US 7,111,401 B2
(45) Date of Patent: Sep. 26, 2006

(54) RAZOR HEAD HAVING SKIN CONTROLLING MEANS

(75) Inventor: Paul D. Richard, Shelton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/769,999

(22) Filed: Feb. 2, 2004

(65) Prior Publication Data

US 2004/0168322 A1 Sep. 2, 2004

Related U.S. Application Data

(60) Provisional application No. 60/444,780, filed on Feb. 4, 2003.

(51) Int. Cl.
*B26B 21/00* (2006.01)
*B26B 21/16* (2006.01)

(52) U.S. Cl. ..... 30/50; 30/59; 30/77; 30/346.5

(58) Field of Classification Search ..... 30/32, 30/50, 49, 43, 47, 77, 81, 82, 346.58, 90, 30/52, 71, 72, 73, 79, 346.6, 346.5, 346.57, 30/353, 59, 51, 63, 74.1, 78, 346, 58
See application file for complete search history.

(56) References Cited

U.S. PATENT DOCUMENTS

| | | | | |
|---|---|---|---|---|
| 2,505,493 | A * | 4/1950 | Herrmann | 30/50 |
| 3,786,563 | A * | 1/1974 | Dorion et al. | 30/50 |
| 4,272,885 | A | 6/1981 | Ferraro | |
| RE30,913 | E * | 4/1982 | Cartwright et al. | 30/47 |
| 4,443,939 | A * | 4/1984 | Motta et al. | 30/49 |
| 4,516,320 | A * | 5/1985 | Peleckis | 30/49 |
| 4,854,043 | A * | 8/1989 | Chen | 30/50 |
| 5,359,774 | A | 11/1994 | Althaus | |
| 5,388,332 | A | 2/1995 | Oldroyd | |
| 5,412,872 | A | 5/1995 | Iderosa | |
| 5,475,923 | A * | 12/1995 | Ferraro | 30/51 |
| 5,501,014 | A * | 3/1996 | Hegemann | 30/50 |
| 5,557,851 | A * | 9/1996 | Ortiz | 30/50 |
| 5,590,468 | A * | 1/1997 | Prochaska | 30/41 |
| 5,781,994 | A * | 7/1998 | Fouillet et al. | 29/890.1 |
| 6,243,951 | B1 * | 6/2001 | Oldroyd | 30/34.2 |
| 2002/0046465 | A1 * | 4/2002 | McCool et al. | 30/50 |
| 2003/0159291 | A1 * | 8/2003 | Clark | 30/50 |
| 2004/0055159 | A1 * | 3/2004 | Khomari | 30/49 |

FOREIGN PATENT DOCUMENTS

| | | |
|---|---|---|
| DE | 449 209 C | 9/1927 |
| EP | 1 252 982 A1 | 10/2002 |
| JP | 09-285663 | 11/1997 |

* cited by examiner

*Primary Examiner*—Boyer D. Ashley
*Assistant Examiner*—Ghassen Alie
(74) *Attorney, Agent, or Firm*—Michaud-Duffy Group LLP

(57) ABSTRACT

A detachable razor cartridge has blade seat and at least one blade having a rectilinear cutting edge. An in-line row of integral guard elements project in cantilever position from the blade seat and extend in spaced relation to and beyond the cutting edge of the blade so that the cutting edge of the blade is unobstructed along its entire cutting length. Enlargements at the free ends of the guard elements disposed forward of and in spaced relation to the blade cutting edge may be provided in a variety of configurations and arrangements for smooth skin engagement to control skin flow and limit the degree of blade cutting edge exposure to skin being shaved.

6 Claims, 3 Drawing Sheets

RAZOR HEAD HAVING SKIN CONTROLLING MEANS

CROSS-REFERENCE TO RELATED APPLICATIONS

This application is entitled to the benefit of and incorporates by reference essential subject matter disclosed in Provisional Patent Application No. 60/444,780 filed on Feb. 4, 2003.

BACKGROUND OF THE INVENTION

This invention relates in general to razor heads and deals more particularly with improvements in razor heads which include means for controlling skin flow to limit the degree of blade edge exposure and thereby reduce the probability of nicks and cuts. Current shaving systems for providing such control, and particularly those of the multi-blade type, generally employ a wire wrapped cartridge for limiting the degree of closeness of a shave. Such systems add parts to a razor head or blade cartridge and generally require additional steps in the manufacturing process to attain the desired skin control feature, all of which add substantially to the cost of producing a razor.

Accordingly, it is the general aim of the present invention to provide an improved razor head or blade cartridge which provides improved skin control without the addition of another component or components to the razor head or cartridge, without the addition of steps to the manufacturing process, and without compromising safety and/or shaving comfort.

SUMMARY OF THE INVENTION

In accordance with the present invention a razor head has a blade seat member which includes a seat body, a seat blade mounted in fixed position on the blade seat member and having an unobstructed cutting edge spaced from the seat body, and a guard assembly for controlling skin flow and limiting the degree of blade cutting edge exposure to skin being shaved and which includes a plurality of discreet spaced apart guard elements carried by and projecting in cantilever position from the seat body below and in spaced relation to the seat blade. The guard elements have free end portions disposed at spaced intervals along and forward of the blade cutting edge which is unobstructed along its entire cutting edge. The free end portions are configured for smooth engagement with the skin.

DETAILED DESCRIPTION OF THE PREFERRED EMBODIMENTS

Figure 1:
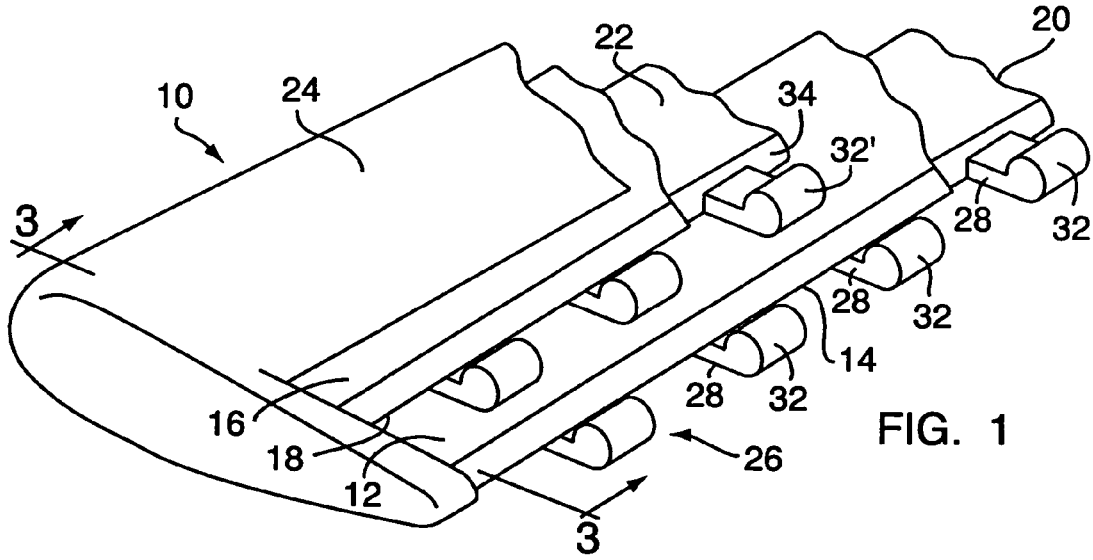
FIG. 1 is a fragmentary perspective view of a detachable blade cartridge embodying the present invention.
Figure 2:
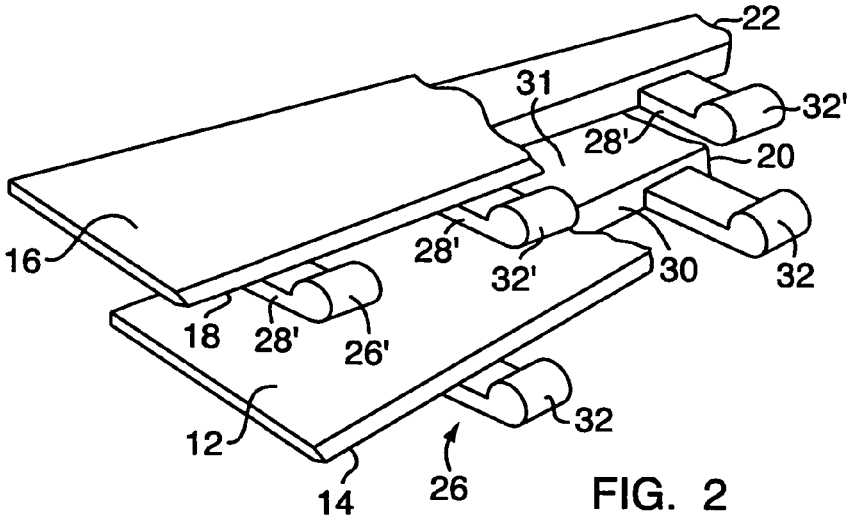
FIG. 2 is a fragmentary perspective view of the blades, blade seat and spacer of the blade cartridge shown in FIG. 1.
Figure 3:
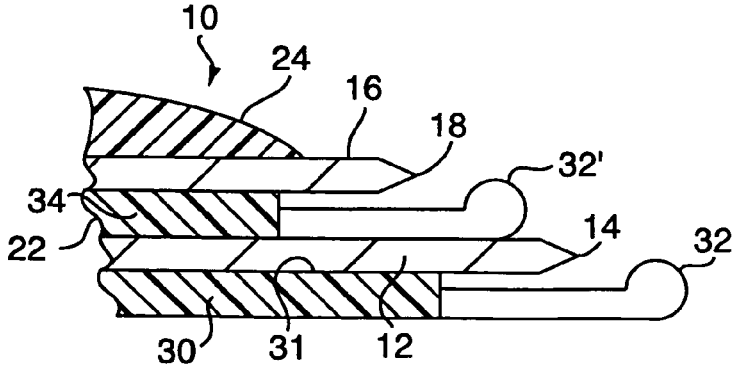
FIG. 3 is a fragmentary sectional view taken along the line 3—3 of FIG. 1.

The razor head of the present invention may take various forms and may, for example, comprise the head portion of a unitary disposable razor of the type having a single blade. However, in FIGS. 1–3 the invention is illustrated and described with reference to a detachable multiple blade cartridge indicated generally by the reference numeral 10. The illustrated blade cartridge 10 essentially comprises a pair of blades which includes a first or seat blade 12, which has a generally rectilinear forwardly facing cutting edge 14, and a second blade 16, which includes a forwardly facing cutting edge indicated at 18. The seat blade 12 is mounted in fixed position on a blade support member or blade seat 20. The second blade 16 is supported on and maintained in spaced relation to the seat blade 12 by another blade support or spacing member 22 sandwiched between the blades. The cartridge 10 further includes a blade cap 24 which overlies the second or upper blade 16, substantially as shown in FIGS. 1 and 3.

In accordance with the invention a guard assembly indicated generally at 26 and which include a plurality of discreet spaced apart guard elements 28, 28 is carried by the blade seat 20. In like manner, a guard assembly 26' which includes a plurality of guard elements 28', 28' is carried by the spacing member or spacer 22. The guard elements 28', 28' are or may be substantially identical to the guard elements 28, 28 carried by the blade seat 12.

Considering now the construction of the blade cartridge 10 in somewhat greater detail, the blade seat 20 is preferably molded from a durable plastic material and comprises a unitary structure which includes a seat body 30 and the guard element 28, 28 which are integrally formed thereon. The seat body 30 has a substantially planar upwardly facing seating surface 31 upon which the seat blade 12 is mounted with its longitudinally extending cutting edge 14 spaced forwardly of the seat body 30, as best shown in FIG. 3. The guard elements 28, 28 project forwardly from the seat body 30 in cantilever position and parallel spaced apart relation to each other below and in spaced relation to the seat blade 12. The guard elements 28, 28 have enlarged free end portions 32, 32 disposed at spaced intervals along and forward of the cutting edge 14 and are configured or shaped for smooth engagement with the skin to be shaved. In accordance with a presently preferred embodiment of the invention, the enlarged free end portions 32, 32 are parti-cylindrical, that is substantially cylindrical except in regions of connection to the cantilever beams which support them on the seat body. The parti-cylindrical free end portions 32, 32 are arranged at longitudinally spaced apart intervals along the length of the blade 12 and in coaxial alignment with each other and axially parallel alignment with the blade cutting edge 14 as best shown in FIGS. 1 and 2.

The construction of the spacer 22 is similar to that of the blade seat 20. Like the blade seat, the spacer 22 is preferably molded from a durable plastic material and has a generally rectangular body portion indicated at 34. The guard elements 28', 28' are integrally formed on the spacer 22 and project forwardly in cantilever positions from the body portion 34. Each guard element 28' has an enlarged free end portion 32' which is preferably parti-cylindrical, as previously described with reference to the corresponding guard elements 28, 28 on the blade seat. The enlarged parti-cylindrical end portions 32', 32', are coaxially aligned and arranged in axially parallel alignment with the cutting edge 18 on the second blade 16. Referring to FIG. 3, it will be noted that the end portions 32', 32' are spaced forwardly of the cutting edge 18 and rearwardly of the cutting edge 14. It will be further noted that the guard elements 28', 28' are spaced downwardly from the second blade 16 and lie along the upper surface of the seat blade 12. It should also be apparent that the cutting edges 14 and 18 are unobstructed along the entire cutting lengths thereof, as best shown in FIGS. 1 and 2.

As will be hereinafter further evident, the guard elements associated with the blade cutting edges and which control skin flow and limit the degree of blade cutting edge exposure to the skin may be arranged in various ways relative to each other and to the cutting edges of the blades. As shown in FIGS. 1 and 2, the blade guard elements 28, 28 and 28', 28' are arranged in a staggered pattern relative to each other along the cutting edges. More specifically, the guard elements 28, 28 and 28', 28' are arranged in alternate series at opposite sides of an imaginary median line disposed between and extending in parallel relation to the blade edges 14 and 18. However, other guard element arrangements are possible and are contemplated within the scope of the present invention.

Figure 4:
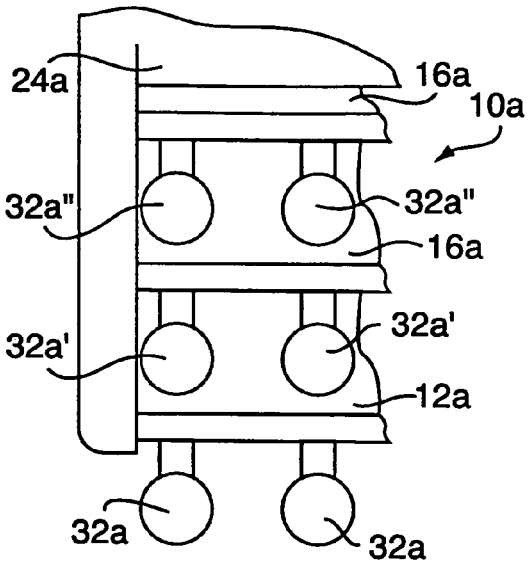
FIG. 4 is a fragmentary top plan view of another blade cartridge having three blades and embodying the invention.
Figure 5:
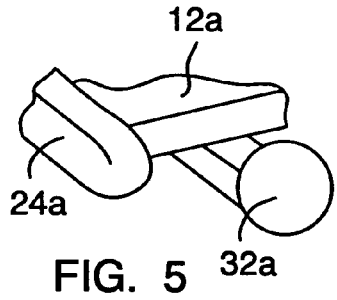
FIG. 5 is a somewhat enlarged fragmentary perspective view of the blade cartridge shown in FIG. 4.

Referring now to FIGS. 4 and 5, another blade cartridge embodying the invention is illustrated and indicated generally by the reference numeral 10*a*. The blade cartridge 10*a* is similar in most respects to the previously described blade cartridge 10 but has three blades which include a seat blade 12*a* and two other blades 16*a*,16*a*. The blade cartridge 10*a* further differs from the blade cartridge 10 in the construction and arrangement of its guard elements. More specifically, the guard elements which comprise the blade cartridge 10*a* have parti-spherical free end portions indicated at 32*a*, 32*a*, 32*a*', 32*a*', and 32*a*", 32*a*". Further, each parti-spherical element 32*a* is transversely aligned with both a parti-spherical element 32*a*' and another such element 32*a*" relative to the longitudinally extending cutting edge 14*a* on the seat blade 12*a*, as shown in FIG. 4.

Figure 6:
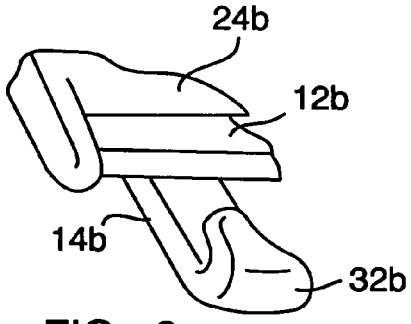
FIG. 6 is a fragmentary perspective view of still another blade cartridge embodying the invention having a single blade and a blade seat which carries another type of guard element.
Figure 7:
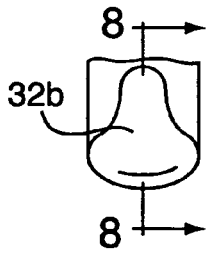
FIG. 7 is a fragmentary plan view of the guard element shown in FIG. 6.
Figure 8:
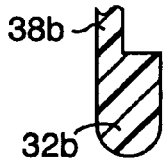
FIG. 8 is a sectional view taken along the line 8—8 of FIG. 7.

In FIGS. 6–8 there is shown still another form of razor head or blade cartridge 10*b* which has a single blade or seat blade 12*b* supported on a blade seat which carries a plurality of smoothly configured guard elements 32*b* (one shown). Each guard element 32*b* has a generally wedge shaped configuration and is characterized by sidewalls which converge toward a tip, as shown in FIG. 6 wherein the sidewalls of the enlarged free end portion 32*b* converge toward the cutting edge 14*b* of a seat blade 12*b*.

Figure 9:
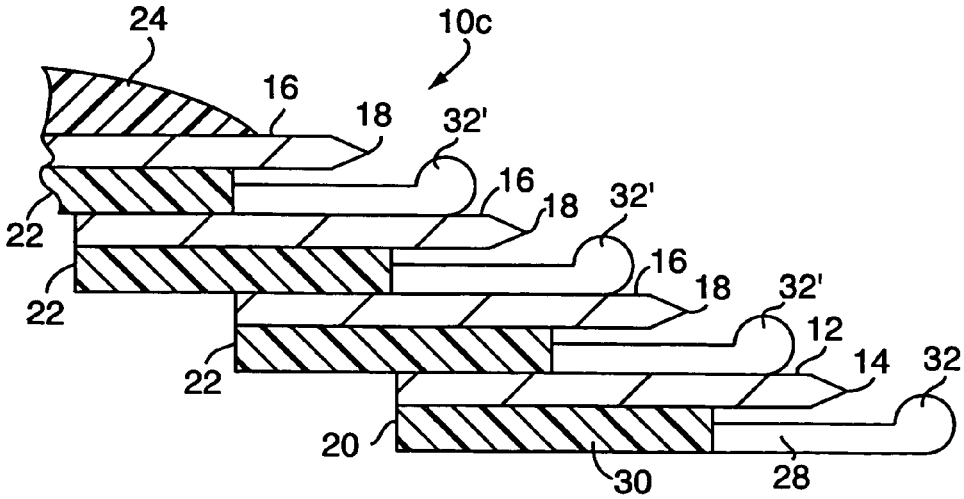
FIG. 9 is similar to FIG. 3, but shows yet another blade cartridge embodying the invention and having four blades.

In FIG. 9 there is shown yet another embodiment of the invention indicated generally by the reference numeral 10*c*. The razor head 10*c* is substantially identical in most respects to the razor head 10 shown in FIGS. 1–3 of the drawings, but differs from the razor head 10 in that it has four blades. Parts of the razor head 10*c* which are substantially identical to parts of the razor head 10 bear the same reference numerals as those of the razor head 10. Consequently, these identical parts will not be hereinafter further described.

Figure 10:
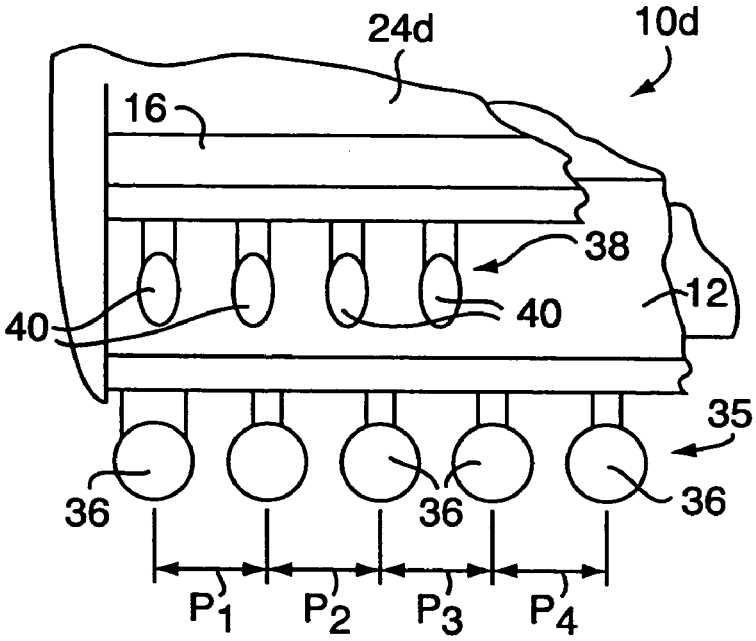
FIG. 10 is a fragmentary top plan view of still another blade cartridge embodying the invention.

Another blade cartridge embodying the present invention and designated generally at 10*d* is shown in FIG. 10. The blade cartridge 10*d* is substantially identical in many respects to razor head 10 illustrated in FIGS. 1–3 of the drawings. Parts of the blade cartridge 10*d* substantially identical to previously described parts of the razor head 10, shown in FIGS. 1–3, bear the same reference numerals as the previously described parts. However, the razor cartridge 10*d* differs from the previously described cartridge 10 in that it has a first in-line array of discreet spaced apart guard elements, indicated generally at 35, associated with the seat blade 12, and which include parti-spherical free end portions indicated at 36. The guard elements, which comprise the first array 35 have a variable pitch, indicated by the letters $P_1$ through $P_4$, the pitch being the distance between the center lines of adjacent guard elements.

A second in-line array of spaced apart guard elements, indicated generally at 38, includes free end portions 40. Each end portion 40 has a generally teardrop configuration. Thus, the guard elements which comprise the first in-line array 35 have differently shaped free end portions than those which form the second in-line array 38.

Figure 11:
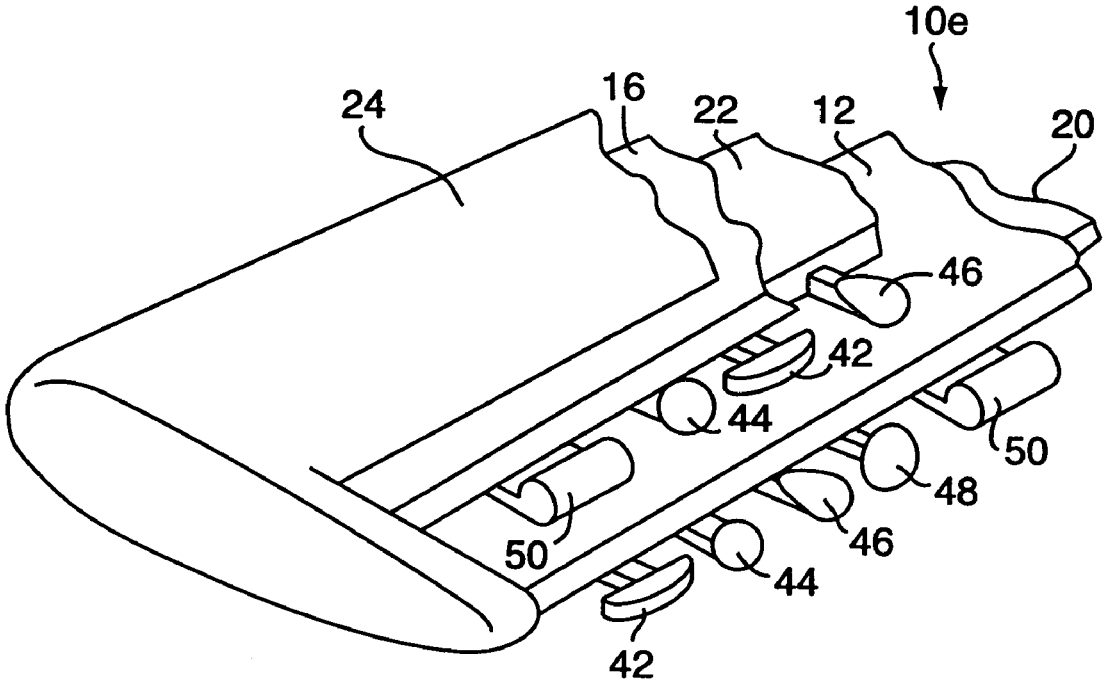
FIG. 11 is a fragmentary perspective view of yet another detachable blade cartridge embodying the present invention.

Yet, another razor head or detachable cartridge embodying the present invention is shown in FIG. 11 and indicated generally by the reference numeral 10*e*. Like the previously described razor head or blade cartridge 10, shown in FIGS. 1–3, the cartridge 10*e* includes a first or seat blade 12 carried by a blade seat 20 and a second blade 16 supported on a spacing member 22 sandwiched between the first and second blades. As in the disposable cartridge 10, a blade cap 24 overlies the upper blade 16 and forms the end walls of the blade cartridge.

The blade cartridge 10*e* differs from the previously described razor head or cartridge 10 in the construction and the arrangement of its guard elements. More specifically, the blade seat 20 carries an in-line array of guard elements having free end portions which differ in shape from each other from one end of the blade cartridge to the other end of the blade cartridge. The fragmentary view of the blade cartridge 10*e* shown in FIG. 11 shows guard elements having free end portions indicated at 42, 44, 46, 48 and 50, which are carried by blade seat 20. The free end portion 42 is shaped generally like a smooth segment of a disk, whereas the next guard element free end portion 44 has a spherical configuration. The element 46 has a generally teardrop form. The next successive element in the series includes a free end portion having a knob shape and indicated at 48. The series of guard elements is further characterized by the parti-cylindrical free end portion 50. Further guard elements (not shown), which complete the series of guard elements associated with the seat blade 12 are each of a different shape, so that the shape of the guard elements in the series change successively from one end of the blade cartridge to the other. Another array of guard elements is carried by the separating member 22 and may include guard elements like some, if not all, of those carried by the blade seat 20 or, if desired, each guard element in the series may have an end portion shaped like no other guard element end portion on the razor head or blade cartridge 10*e*. Thus, effective skin control may be achieved by employing diverse skin engaging guard elements which also provide pleasing skin sensation.

It will be apparent that each of the differing smoothly configured guard element free end portions hereinbefore described will produce a somewhat different skin flow reaction to shaving pressure. Thus, by changing one or more of the characteristics of any of the aforedescribed razor heads, including the configuration of the free end portions, the spacing or pitch between adjacent guard elements, the thickness of the spacers, the arrangement of the guard elements relative to each other and/or the spacing between the enlarged end portions of the guard elements and the unobstructed cutting edges of the blades variations in skin flow and blade exposure to skin to be shaved may be attained, whereby a razor may be produced which is particularly suited to the skin condition of a user. These results may be attained without significant changes in product design and/or product manufacturing process.

What is claimed is:

1. A razor head comprising;

a blade support including a support body having an upwardly facing seating surface, a seat blade supported on said seating surface and having a rectilinear longitudinally extending first cutting edge spaced forwardly of said support body, a spacer supported on said seat blade and including a spacer body spaced rearwardly of said first edge, a second blade supported on said spacer above said seat blade and having a rectilinear longitudinally extending second cutting edge parallel to said first cutting edge and spaced forwardly of said spacer body and rearwardly of said first cutting edge, and a guard assembly for limiting the degree of blade cutting edge exposure to skin being shaved including a first longitudinally extending in-line array of discrete spaced apart guard elements carried by said blade support and projecting forwardly in cantilever position from said blade support body in downwardly spaced relation to said seat blade and terminated by end portions spaced forwardly of said first cutting edge and configured for smooth engagement with skin being shaved, and a second in-line array of discrete spaced apart guard elements carried by said spacer and projecting forwardly in cantilever position from said spacer body in downwardly spaced relation to said second blade and terminated by end portions spaced forwardly of said second cutting edge and rearwardly of said first cutting edge and configured for smooth engagement with the skin, said cutting edge of said first blade and said cutting edge of said second blade being unobstructed along the entire cutting lengths thereof, wherein said guard elements carried by said blade support and said guard elements carried by said spacer are arranged in alternate series at opposite sides of a median line disposed between and extending in parallel relation to said first and said second cutting edges.

2. A razor head as set forth in claim 1, wherein said guard elements are integrally connected to said blade support and said spacer, respectively, and comprise integral parts thereof.

3. A razor head as set forth in claim 1, wherein said end portions comprise enlarged end portions.

4. A razor head as set forth in claim 3, wherein said enlarged end portions are parti-cylindrical and coaxially aligned with each other.

5. A razor head as set forth in claim 4, wherein said parti-cylindrical enlarged end portions are axially parallel to said first cutting edge and said second cutting edge.

6. A razor head as set forth in claim 1, wherein said razor head comprises a detachable blade cartridge.

* * * * *